United States Patent [19]

Howe

[11] 4,204,403

[45] May 27, 1980

[54] COMBUSTION SYSTEMS

[75] Inventor: David M. Howe, Bristol, England

[73] Assignee: Rolls-Royce Limited, London, England

[21] Appl. No.: 906,216

[22] Filed: May 15, 1978

[30] Foreign Application Priority Data

May 21, 1977 [GB] United Kingdom ..... 21505/77

[51] Int. Cl.[2] ..... F02C 7/22

[52] U.S. Cl. ..... 60/743; 60/749

[58] Field of Search ..... 60/39.36, 39.65, 39.74 R, 60/39.74 B; 431/351, 352, 177

[56] References Cited

U.S. PATENT DOCUMENTS 3,287,905 11/1966 Bayard .

3,483,700 12/1964 Ryberg et al. ..... 60/39.74 B 3,722,216 3/1973 Baha et al. ..... 60/39.36

*Primary Examiner*—Louis J. Casaregola

*Attorney, Agent, or Firm*—Stevens, Davis, Miller & Mosher

[57] ABSTRACT

The disclosure of this invention pertains to an annular combustion chamber for a gas turbine engine. The chamber has at its upstream end an annular array of baffles defining inlet passages for air or air/fuel mixture. The baffles overlap in the circumferential sense so that air or air/fuel mixture entering passages is directed by the baffles into a circumferential swirl. Those surfaces of the baffles which are open to the interior of the chamber are swept by the fluid emerging from the passages to be cooled thereby.

3 Claims, 6 Drawing Figures

COMBUSTION SYSTEMS

This invention relates to combustion systems of the kind having a combustion chamber provided with structure defining inlet passages for air or air/fuel mixture continually flowing into the chamber and there mixing with already burning mixture.

Insofar as such structures are contacted by relatively slowly moving masses of partially burnt mixture, they are subject to formation of solid carbon deposits. Insofar as such structures project into relatively hot regions of the flame system they are subject to melting. It is an object to reduce at least one of these difficulties.

According to this invention there is provided a combustion system having a combustion chamber comprising an array of air inlet passages distributed symmetrically about an axis, and means provided at at least selected said passages for adding fuel to air flowing therethrough, an annular array of baffles any two of which form between them a said passage, the baffles overlapping one another in the circumferentail direction about said axis so that any one baffle has at one side a surface lying at the inside of a said passage and has at the other side a surface open to the interior of said chamber and that, in operation, fluid emerging from said passages sweeps over said open surfaces.

The fluid sweeping over said open surfaces provides a cooling film protecting those surfaces from burning mixture within the chamber, and the intrinsically relatively rapid movement of the fluid over the open surfaces inhibits the formation of solid carbon deposits thereon.

An embodiment of the invention will now be described with reference to the accompanying drawings in which: FIG. 1 is a diagrammatic longitudinal section of a gas turbine engine;

Figure 1:
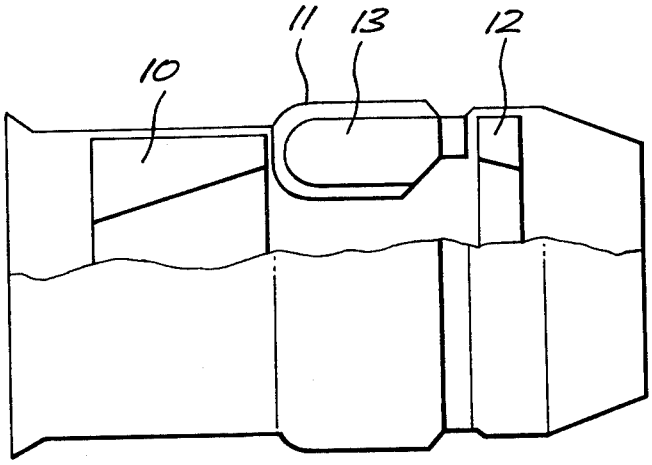
Figure 3:
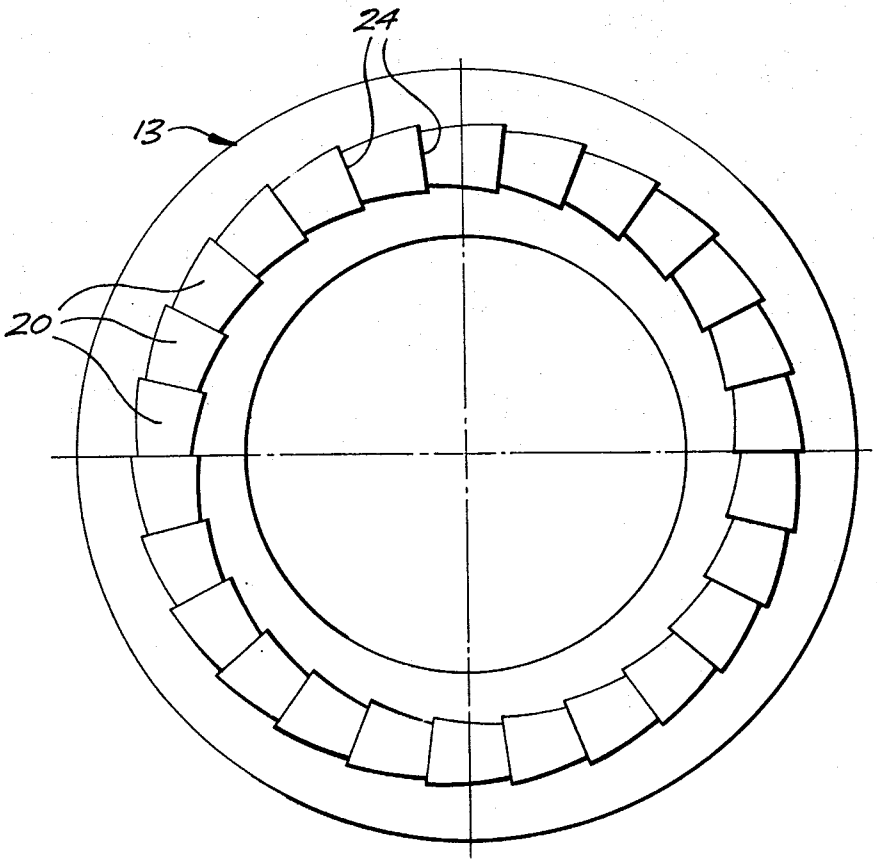
FIG. 3 is a view looking upstream in the direction of arrow III in FIG. 2.
Figure 2:
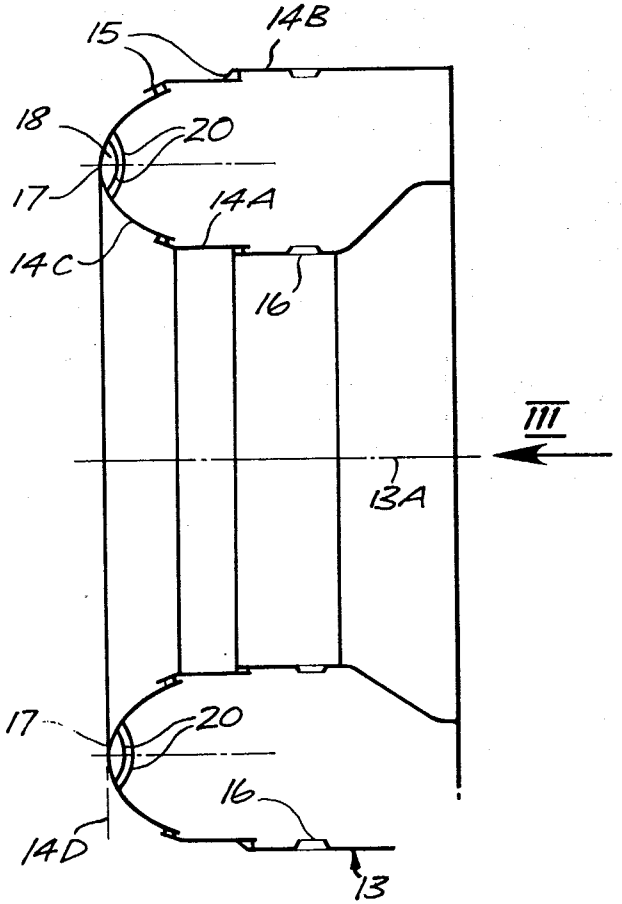
FIG. 2 is an enlarged detail of FIG. 1 and shows the combustion chamber of the engine shown in FIG. 1.

FIG. 1 shows a gas turbine engine comprising, in flow series, a compressor system 10, a combustion system 11 and a turbine system 12. Air compressed in the compressor system 10 is delivered to the combustion system 11 where fuel is burnt and the products of combustion drive the turbine system 12. The compressor system and turbine system may comprise one or more spools or shafts.

The combustion system 11 includes an annular chamber 13 having an axis 13A. The chamber 13 comprises two generally cylindrical side walls 14A,14B and an annular head wall 14C defining the upstream end of the chamber. The wall 14C lies generally in a plane 14D transverse to the axis 13A. At the inside of the wall 14C there is provided an array of baffles 20 arranged symmetrically about the axis 13A. The baffles are inclined, all in the same sense, relative to the plane 14C and overlap one another in the circumferential direction about the axis 13A. Any two adjacent baffles form between them an inlet passage 18 for admission of air or air/fuel mixture to the chamber 13. Each passage commences with an aperture 17 in the wall 14C and ends at an outlet slot 24 between two adjacent baffles.

By virtue of the inclined position and the overlapping relationship of the baffles 20 each such baffle has at one side a surface 25A lying at the inside of one passage 18 and has at the other side a surface 25B which lies at the outside of that passage downstream of the outlet slot 24 and is open to the interior of the chamber 13.

Said inclined position and overlapping relationship has the effect that, in operation, fluid emerging from the slot 24 sweeps over the open surface 25B and provides a cooling film protecting the surface from burning mixture within the chamber. Also the flow of air or mixture over the surface 25B is unobstructed so that there is no occasion for the velocity of flow through the passage 18 to be significantly diminished. In consequence the said cooling film is not likely to be slowed e.g. by turbulence and the tendency for solid carbon to become deposited on the baffles is low.

Figure 6:
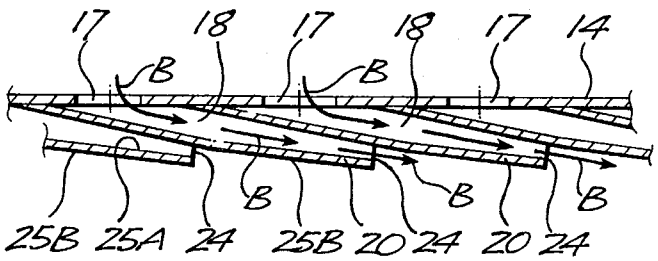
FIG. 6 is a section on the line VI—VI of FIG. 5.
Figure 4:
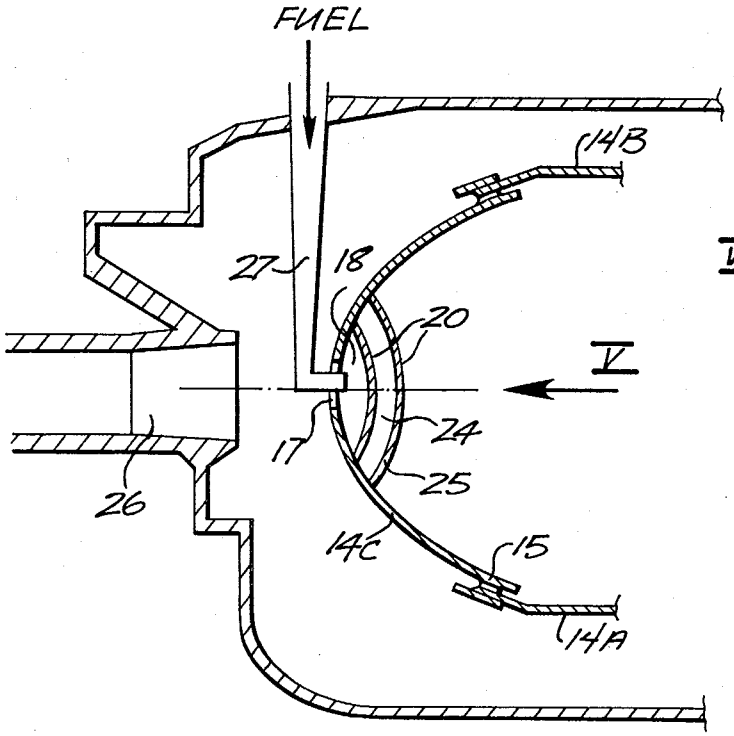
FIG. 4 shows a detail of the chamber of FIG. 2 to a further enlarged scale.

The air to the chamber 13 is derived from a diffuser 26 defining the delivery end of the compressor 10. The flow from the diffuser is generally in the direction of the axis 13A and the baffles 20 act to turn that flow through nearly 90° as indicated by arrows B (FIG. 6). In consequence the flow enters the chamber 13 with a swirl about the axis 13A. Fuel injectors 27 are provided to add fuel to the air flow entering the passages 18. The fuel may emerge from the injectors in the form of a spray against the confronting surface 25A of the adjacent baffle. The fuel mixes with the air and may at least partially vapourize in the passage 18. The fluid emerging from the slots 24 is a fuel-rich mixture of air and fuel droplets or fuel vapour. This mixture is ignited by already burning mixture in the so-called primary or pilot zone, i.e. the zone adjacent the wall 14C, of the chamber 13. The abovementioned swirl causes the fresh mixture to have a relatively long residence time in the primary zone as is desirable for combustion in the primary zone to become well-established. As is known per se, the rich pilot flame provided by the primary zone progresses downstream through the chamber where air is added through openings 15,16 to dilute the mixture and establish a desirably lean air/fuel ratio.

Preferably, the fuel injectors 27 are provided only at alternate apertures 17 so that flow from the slots 24 is alternately mixture and air. This contributes to the cooling of the baffles. However, downstream of the slots 24 the alternate flows of mixture and air become interdigitated so that a good situation exists for the continued mixing of fuel and air.

The proportions of the baffles which bring about the above conditions are necessarily a matter for experiment but good results have been achieved with baffles which overlap by about 50%, i.e. where the inner surface 25A is about half as long (in the direction of flow through the passage 18) as the outer or open surface 25B.

Figure 5:
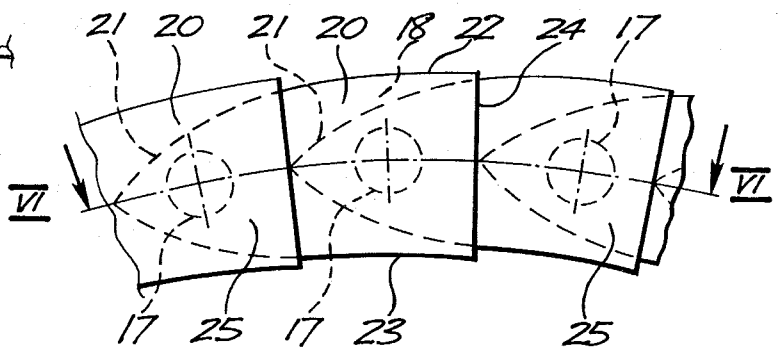
FIG. 5 is a view in the direction of arrow V in FIG. 4.

The wall 14C is curved in radial cross-section so as to be concave to the interior of the chamber 13. The baffles 20 are curved in the opposite sense, i.e. they are concave to the wall 14C. Each baffle 20 has a convergent end 21 around the aperture 17 (FIG. 5) and a parallel-sided portion 22,23 where extending downstream of the slot 24. The baffles 20 are secured to the 14C e.g. by welding.

I claim:

1. A combustion system comprising a combustion chamber having an array of air inlet apertures distributed symmetrically about an axis, an annular array of baffles any two of which form between them a passage, each of said passages registering with an aperture, the baffles overlapping one another in the circumferential direction about said axis so that any one baffle has at one side a surface lying at the inside of a said passage and has at the other side a surface open to the interior of said chamber whereby, in operation, fluid emerging from said passages sweeps over said open surfaces, means to supply air to said apertures and thus to said passages, means for adding fuel to the air flow through every other one of said passages so that baffle is swept at one side by air and at the other side by air/fuel mixture.

2. Apparatus according to claim 1 wherein the combustion chamber is annular having generally cylindrical inner and outer walls and an annular wall defining its axial end, said apertures being in said axial end wall, and said baffles being secured to said annular wall at the side thereof facing the interior of the chamber.

3. Apparatus according to claim 2 wherein said annular wall is concave to the interior of the chamber and said baffles are each concave to the annular wall.

* * * * *